US005129836A

United States Patent [19]

Ursich

[11] Patent Number: 5,129,836

[45] Date of Patent: Jul. 14, 1992

[54] SELF-LOCKING FEMALE RECEPTOR FOR ELECTRICAL CORD

[76] Inventor: Nels E. Ursich, 17515 Sandalwood Dr., Apt. 104, Tinley Park, Ill. 60477

[21] Appl. No.: 719,930

[22] Filed: Jun. 24, 1991

[51] Int. Cl.[5] ..... H01R 4/50

[52] U.S. Cl. ..... 439/346; 439/348

[58] Field of Search ..... 439/134, 140, 345, 346, 439/347, 348, 369

[56] References Cited

U.S. PATENT DOCUMENTS

| | | | |
|---|---|---|---|
| 2,732,531 | 1/1956 | Janowiec | 439/346 |
| 3,200,365 | 8/1965 | Carpinone | 439/346 X |
| 4,909,749 | 3/1990 | Long | 439/346 |

FOREIGN PATENT DOCUMENTS 0122842 10/1984 European Pat. Off. .

*Primary Examiner*—Neil Abrams
*Assistant Examiner*—Khiem Nguyen
*Attorney, Agent, or Firm*—Edward D. Gilhooly, Ltd.

[57] ABSTRACT

A female receptor for locking a male plug and having an actuator element accessible from an exterior position. The actuator element comprises an elongated shaft having an area of reduced width to permit disengaging movement of internal balls mounted in the receptor body. The balls retain the prongs of the male plug in place when the area of reduced width of the rod is not aligned with the balls.

9 Claims, 1 Drawing Sheet

FIG. 1
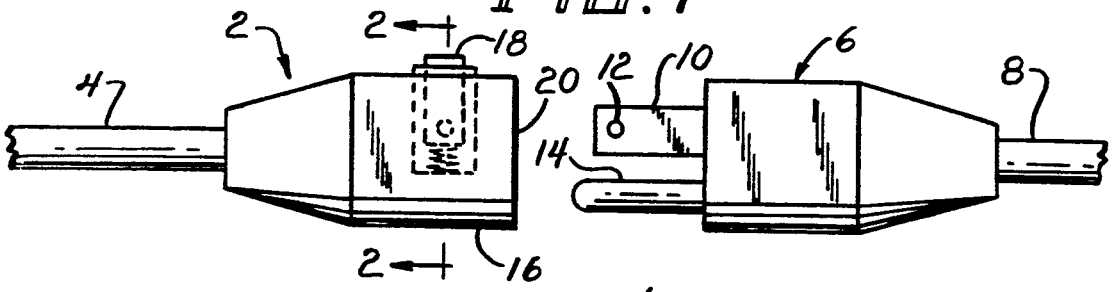
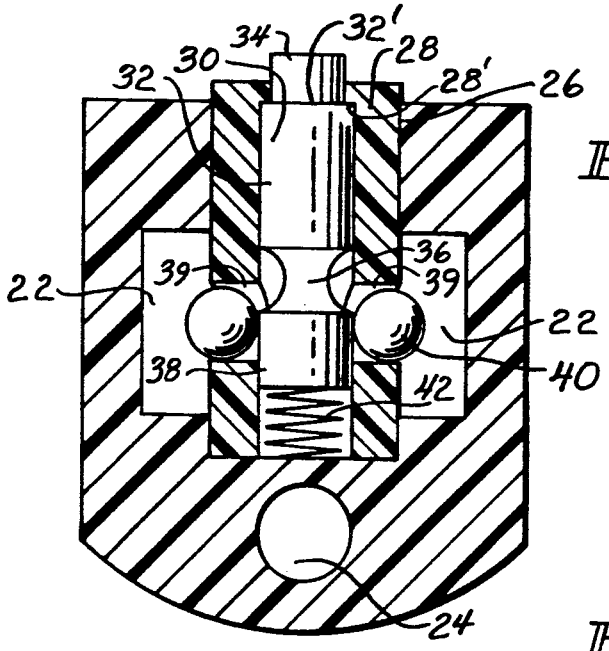
FIG. 2
FIG. 3
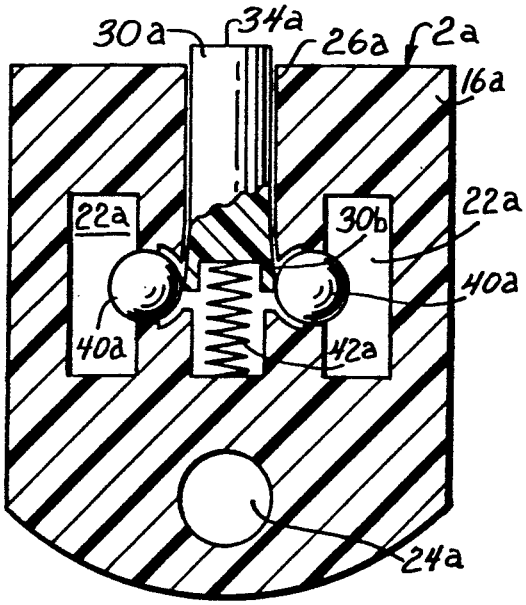
FIG. 4
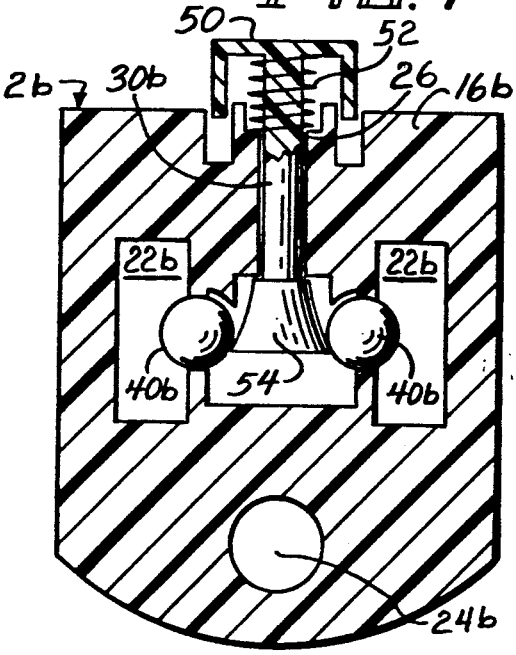

SELF-LOCKING FEMALE RECEPTOR FOR ELECTRICAL CORD

BACKGROUND OF THE INVENTION

1. Field of the Invention

This invention relates to electrical cords and, more specifically, to a self-locking female electrical receptor for an electrical cord.

2. Summary of the Prior Art

A multitude of female receptor and male plugs have been introduced in the prior art to create a connection between electrical lines. For example, it is common to use extension cords by which electrical power can be delivered to a location remote from an electrical outlet or source of electrical potential. Extension cords are often used for many tasks, including in the home, at work and other locations. A persistent problem in the use of electrical connections between plugs and receptors results from the undesired disconnection of the plug from the socket during use. This can occur when an electrical device, such as a tool or other electrical equipment, must be manipulated in a fashion that the cord is pulled relative to the other cord and the plug is pulled out of its insertion in the female receptor. An example of such an occurrence is present when a workman is on a roof using an electrical tool and as he operates the device, the extension cords or other lines become disconnected at a location near the ground. When such occurrences are presented, the workman must climb down the ladder and reconnect the male plug with the female receptor. Such occurrences are inconvenient and frustrating, and interfere with the productivity of the worker.

There have been attempts in the prior art to lock the plug into a female receptor so that a more secure electrical connection is created. Examples of prior art techniques for creating a locked relationship between male and female electric connectors are disclosed in U.S. Pat. No. 2,198,504 to Poole; U.S. Pat. No. 2,631,185 to Earle et al; U.S. Pat. No. 2,664,734 to McEneaney; and U.S. Pat. No. 4,179,175 to Farnworth et al and U.S. Pat. No. 4,566 297 to Hawley. Although the devices in the foregoing patents disclose several techniques for creating a locking arrangement between a male plug and female receptor, the locking techniques of these patents do not provide an optimumly efficient and easy to use device. The locking functions of the patents of the foregoing prior art do not provide an easy connect/disconnect to permit a user to engage and disengage the locking features by merely depressing an actuator. The prior art either requires elaborate elements to create a locking relationship, some of which are permanent in nature, or do not permit the ready disengagement as is needed in effective connection and disconnection. For these reasons, it is desirable to provide an improved electrical connection relationship between a female receptor and a male plug that is economic to manufacture, and safe and convenient to use.

SUMMARY OF THE INVENTION

It is an objective of the present invention to provide an effective and economical female electrical receptor which will efficiently lock a male plug element of an electrical line or cord to prevent accidental disconnection. The female receptor of the invention is provided with locking elements that are uniquely arranged to engage the typical punch holes provided in the male prongs of an electrical plug. Without other tools, the locking elements of the invention are locked in position by depression of an exterior arranged actuator which is also used to permit the plug to be easily removed. The receptor of the invention is highly efficient in use and is provided with safety features to prevent injury from shocks and the like.

BRIEF DESCRIPTION OF THE DRAWINGS

FIG. 1 is a side elevational view of the improved locking electrical female receptor of the invention adjacing a male electrical plug;

FIG. 2 is an end elevation view, with parts in section, of the female receptor of the invention of FIG. 1 taken along lines 2—2;

FIG. 3 is an end elevational view, with parts in section, of a second embodiment of the female receptor of the invention; and FIG. 4 is an end elevational view, with parts and section, of a third embodiment of the locking female of the invention.

DESCRIPTION OF THE PREFERRED EMBODIMENTS

Referring now to FIG. 1, there is illustrated the general arrangement of the improved locking female receptor of the invention for electrical cords which is generally designated by reference numeral 2. Electrical female receptor 2 is connected to a typical electrical line or cord 4 having an exterior electrical insulation. The female receptor 2 is intended to be interlocked with a male plug 6 which is attached to a second electrical line or cord 8. The male plug 6 and female receptor 2 can be attached to any conductive electrical lines, such as in connection with extension cords and other numerous uses well known in the art. The male plug 6 is conventionally provided with a pair of exterior prongs 10 formed from a metal conductive material. Each prong 10 includes a punched hole 12, and a ground prong 14 is also affixed to the male plug 6 as is well known.

The female receptor 2 of the invention is formed as a molded receptor body 16 from a suitable material, such as a molded plastic and the like, that is electrically non-conductive. The end face 20 of the female receptor body 16 is provided with a pair of plug holes 22 and a grounding hole 24 that are arranged to receive respectively the prongs 10 of the male plug 6 and the grounding prong 14. The insertion of the prongs 10 and grounding prong 14 into the female receptor 2 will result in an improved electrical connection being made between the respective electrical cords 4 and 8.

The receptor 16 is formed with a passage 26 that extends downward into the body 16 and is in communication with the plug holes 22. A cylindrical sleeve 28 is fixedly positioned within the hole 26 of the receptor body 16 and is also formed from an electrically non-conductive material. An elongated shaft 30 comprising an electrically non-conductive material, such as a plastic and the like, is movably positioned within the central passage 28' of sleeve 28. The elongated shaft 30 includes an upper portion 32 having a shoulder 32' to engage a flange 28' of the sleeve 28. An upper portion 34 of the movable shaft 30 provides a manual depressible actuator situated at an accessible exterior position on the body 16. An intermediate portion of the shaft 30 has a concentric area 36 having a reduced diameter and creating a profile to correspond to a spherical shape as will be apparent. The bottom portion 38 of shaft 30 is cylindrical in shape and has generally the same diameter as the internal passage 28' through sleeve 28 as is best shown in FIG. 2. A pair of openings 39 in the sleeve 28 capture a pair of balls 40 for limited movement outward from the holes 39 due to the reduction of the width of the openings 39 at the peripheral surface of the sleeve 26.

The balls 40 are permitted movement into the narrowed down portions 36 of the shaft 30 when the portions 36 are in confronting alignment with the sleeve openings 39 and the balls 40 are deflected towards the shaft 30. Such alignment occurs by depressing the upper actuator portion 34 of the shaft 30 for movement downward relative to the sleeve 26. A spring 42 insures that the plug 30 is returned to the upper position as shown in FIG. 2 when the upper portion 34 is released. It should be apparent, therefore, that the prongs 10 may be inserted into the plug openings 22 of receptor 2 when the shaft 30 is depressed for alignment of the narrowed down portion 36 with the openings 39 in sleeve 28. The plug prongs 10 therefore can deflect the balls 40 inward, and entry of the prongs 10 into the receptor 2 is possible.

The axial position of the balls 40 in the sleeve 22 is selected to correspond to the position of the prong holes 12 when the prongs 10 are fully inserted into the receptor 2. Therefore, as the upper actuator portion 34 is released, the lower portion 38 of the shaft 30 pushes and biases the balls 40 outward into a locking engagement with respective prong holes 12, such that a locked connection between female receptor 2 and male plug 6 is attained. Release of the male plug can only occur by again pressing shaft 30 at upper portion 34 to align the narrowed down portion 36 of shaft 30 with the balls 40, such that the balls can easily be deflected inwardly as the prongs 10 are pulled out for removal. Since the shaft 30 and sleeves 28 are formed from an electrically nonconductive material, such as plastic, the user is not exposed to the hazards of electrical shock when manipulating the external actuator portion 34. The spherical balls 40 are formed from a suitable metal material and the like, such as stainless steel and aluminum, that will resist corrosion during use.

Referring now to FIG. 3 there is illustrated a second embodiment of the locking female receptor 2 of the invention, generally designated by reference numeral 2a. The female receptor 2a includes a molded plastic body 16a having a hole 26a in which a shaft 30a extends downward. The shaft 30a is a solid, generally cylindrical plastic member, having a flared lower end 30b which is arranged to engage the pair of balls 40a provided in the female receptor body 16a as in the preceding embodiment described with reference to FIG. 2. The shaft 30a is resiliently biased upward by spring 42a. When the upper portion 34a of the shaft 30a is manually depressed, flared bottom end 30b of the shaft 30a is oriented beneath the ball 40a to permit deflection of the balls when the plug prongs 10 are inserted into receptor holes 22a. Release of the shaft 30a will cause the flared end portions 30b to urge the balls 40 outwardly into biased engagement with the prong holes 12 of plug 6 as in the previous embodiment. Thus, to release the prongs 10 from the receptor, the shaft 30a must be depressed to bring a portion of the shaft 30a having a reduced diameter adjacent to balls 40a so that the balls can easily be deflected inward and the prongs 10 released for removal of the male plug 6.

Referring now to FIG. 4 there is illustrated still another embodiment of the locking female receptor, generally designated by the reference numeral 2b. The embodiment of FIG. 4 also includes a molded receptor body 16b, a pair of plug prong holes 22b and a receptor hole 26b for receiving a shaft 30b. The shaft 30b includes a cylindrical central portion extending down into the receptor in hole 26b which hole is enlarged in a central portion of the receptor 16b. The shaft is provided with an upper actuating head 50 integrally affixed to shaft 30b. A biasing spring 52 is disposed between the actuator head 50 and the receptor body 16b in surrounding relationship to the shaft 30b. The bottom of the shaft 30b is provided with a flared out portion 54 having a maximum diameter at its bottom. In the position shown in FIG. 4, the flared out bottom portion 54 presses the balls 40b outward into locked relationship with the prong holes 12 of the plug 6. Thus, to insert the prongs 10 into the female receptor 2b, it is necessary to depress the shaft 30b so that the flared out portion 54 moves beneath the balls 40b and the prongs can deflect the balls inward toward the reduced diameter of the shaft 30b. Upon release of the shaft 32b, the spring 52 moves the shaft 30b upward to the position shown in FIG. 4 for pressing the balls 40b into contact with the prong holes 12 in a locking relationship as in the prior embodiment. Release of the plug 6 can be occasioned by depressing the shaft 32 which permits the balls 40b to be deflected in as the plug 6 is pulled out of its female receptor 2b.

In the foregoing embodiments of the invention it should be apparent that the male plug 6 is retained in locked position in the female receptor and can be released from a convenient actuator positioned exteriorly of the receptor for convenient use. The invention in the application provides an economical device that is easy to use and effective in its maintaining a locked relationship between connected cords for both reasons of convenience and safety.

What is claimed is:

1. A locking female electrical receptor comprising a female receptor body having a pair of holes for receiving prongs having punched holes of a male plug for electrically connecting two electrical lines respectively coupled to said receptor body and the male plug, said receptor body having actuator means mounted for selective relative movement within said receptor body, said actuator means having a manually operated element being accessible from the outside of said receptor body, a pair of locking elements mounted in said receptor body in operative relationship to said actuator means for selectively engaging the punched holes of the male plug locking the prongs of the male plug to said receptor body, said actuator means being movable to a first position for permitting insertion and removal of the prongs relative to said locking elements, and said actuator means comprising a cylindrical member having a portion being movable to a second position by resilient means relative to said locking elements in said receptor for urging said locking elements into locking contact with the prongs of the male plug.

2. The female receptor according to claim 1 wherein said locking elements are a pair of balls.

3. The female receptor according to claim 2 further including resilient means for urging said actuator means to said second position.

4. A locking female electrical receptor comprising a female receptor body having a pair of holes for receiving the prongs of a male plug for electrically connecting two electrical lines respectively couples to said receptor body and the male plug, said receptor body having actuator means mounted for selective relative movement within said receptor, said actuator means having a manually operated element being accessible from the outside of said receptor body, a pair of locking elements mounted in said receptor body in operative relationship to said actuator means for selectively locking the prongs of the male plug to said receptor body, said actuator means being movable to a first position for permitting insertion and removal of the prongs relative to said locking elements, said actuator means being movable to a second position in said receptor for urging said locking elements into locking contact with the prongs of the male plugs, said locking elements are a pair of balls, resilient means for urging said actuator means to said second position, said actuator means includes an elongated shaft movable in said receptor body and being in operative contact with said balls, said shaft having a reduced width aligned with said balls in said first position to permit disengagement of said balls.

5. The female receptor according to claim 4 wherein said actuator means includes a sleeve having aligned openings, said shaft being movable in said sleeve, and said balls being retained on said sleeve.

6. The female receptor according to claim 5 wherein said reduced width of said rod is a narrowed down portion of said shaft for permitting movement of said balls for disengagement.

7. The female receptor according to claim 4 wherein said shaft includes a flared end portion arranged to contact said balls in said second position of said shaft.

8. The female receptor according to claim 7 wherein said resilient means is a spring mounted at an exterior position of said receptor body.

9. The female receptor according to claim 7 wherein said resilient means is a spring mounted in said receptor body adjacent said flared end.

* * * * *